United States Patent [19]

Moiroux

[11] Patent Number: 4,513,697

[45] Date of Patent: Apr. 30, 1985

[54] PISTON FOR INTERNAL COMBUSTION ENGINE

[75] Inventor: Auguste Moiroux, Ecully, France

[73] Assignee: Societe Civile Styled: BMB, Paris, France

[21] Appl. No.: 573,211

[22] Filed: Jan. 23, 1984

[30] Foreign Application Priority Data

Jan. 27, 1983 [FR] France ..... 83 01236

[51] Int. Cl.[3] ..... F02P 1/04

[52] U.S. Cl. ..... 123/41.35; 123/193 P

[58] Field of Search ..... 123/41.34–41.36, 123/193 R, 193 P

[56] References Cited

U.S. PATENT DOCUMENTS

| | | | |
|---|---|---|---|
| 195,585 | 9/1877 | Dieckmann | 123/41.35 |
| 942,140 | 12/1909 | Hay | 123/41.35 |
| 1,608,811 | 11/1926 | Raven | 123/41.35 |
| 1,682,357 | 8/1928 | Sperry | 123/41.35 |
| 3,314,402 | 4/1967 | Tillack | 123/193 P |
| 4,013,047 | 3/1977 | Harned | 123/41.35 |
| 4,470,375 | 9/1984 | Showalter | 123/41.35 |

FOREIGN PATENT DOCUMENTS

| | | | |
|---|---|---|---|
| 0015216 | 10/1910 | United Kingdom | 123/41.35 |

*Primary Examiner*—Craig R. Feinberg
*Attorney, Agent, or Firm*—Lewis H. Eslinger

[57] ABSTRACT

Piston for internal combustion engine, such as for a free piston engine, of the type comprising one assembly of two co-axial pistons, the inner cylinder having an external diameter which is substantially less than the inner diameter of the outer cylinder, thus defining a closed annular chamber designed to receive a cooling fluid. Longitudinal ribs are provided in the closed annular chamber which ribs extend over most of the height of said chamber and are inclined in alternate directions with respect to the piston axis, thus defining in said chamber, a succession of adjacent longitudinal channels whose section increases from one end of the piston to the other.

3 Claims, 2 Drawing Figures

PISTON FOR INTERNAL COMBUSTION ENGINE

The present invention relates to a piston for use in internal combustion engines.

The problem raised by the cooling of pistons in internal combustion engines is a known fact, particularly in the case of free piston engines. It has already been proposed in French Pat. No. 2 441 073 to provide inside the hollow driving piston, a lining co-axial to the piston, and to maintain between the piston and its lining, a circulation of a cooling fluid contained in the piston, under the action of the piston movement. Tests have however shown that the efficiency of the resulting cooling can be further improved with a number of dispositions designed to regulate the circulation of the fluid inside the piston.

It is the object of the present invention to provide longitudinal ribs inside the closed annular chamber situated between the piston and its inner lining, said ribs extending over most of the height of the chamber and being inclined in alternate directions with respect to the piston axis, thus defining in said chamber, a succession of adjacent longitudinal channels of section increasing (or decreasing) from one end of the piston to the other.

The invention will be more readily understood on reading the following description with reference to the accompanying drawings in which.

Figure 1:
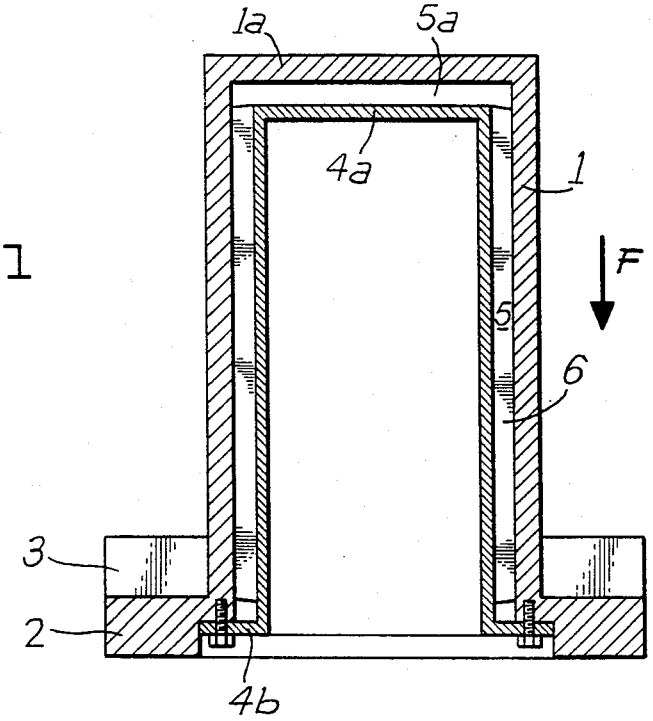
FIG. 1 is a cross-sectional view of a piston according to the invention.

Referring to the drawings, these show a driving piston 1 more particularly designed for a free piston engine. Indeed, at one of its ends, which is opposite the end designed to penetrate into the engine combustion chamber, the cylindrical piston 1 is provided with an annular part 2 equipped with blades 3. Said part 2 is designed as we know, to constitute the scavenging pump of the engine and moves inside a chamber of relatively low temperature.

Inside the hollow piston 1 is placed a cylindrical lining 4 co-axial to said piston. A shoulder **4*b* of the lining 4 enables to fix the latter on the annular part 2 of said piston. The outer diameter of lining 4 is less than the inner diameter of piston 1 so that the assembly defines an annular chamber 5 insulated from the outside. In general, said chamber 5 will not be limited exactly to the annular volume defined by the piston and by its lining; on the contrary, said lining 4 will be preferably closed off by a bottom 4*a* which is at a certain distance from the bottom 1*a* of the piston moving inside the combustion chamber of the engine. Thus, as illustrated in the drawing, the sealed chamber 5 comprises an annular part and a substantially flat volume (5*a*) between bottoms 4*a* and 1*a***.

Substantially longitudinal ribs 6 are provided in the thickness of the annular part of chamber 5. These ribs extend, as illustrated, on virtually the entire height of the piston, stopping just short of the shoulder **4*b*. On the side of bottom 4*a*, the ribs extend substantially as far as that bottom, but without a flat volume 5*a*, they should stop short of the bottom 1*a*** of the piston.

Figure 2:
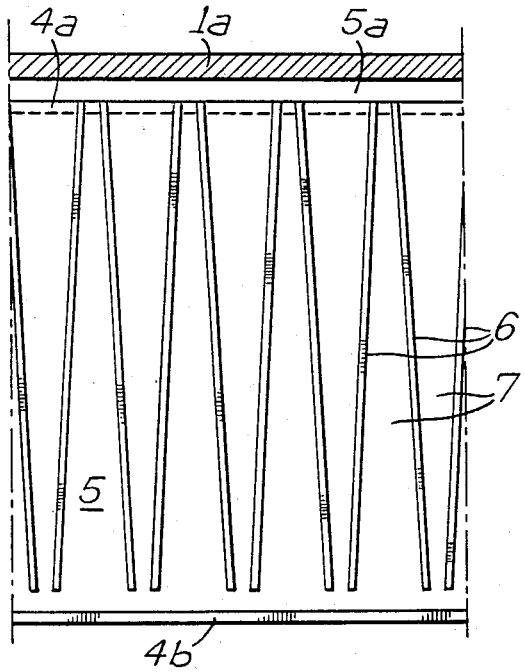
FIG. 2 is a detailed view of the outer surface of the piston lining.

Preferably, the ribs 6 are constructed with the lining 4, and, as shown in FIG. 2, they are slightly inclined with respect to the lining axis, in alternate directions. Thus, these ribs 6 which are very slightly helical, define adjacent longitudinal channels 7, throughout the entire annular portion of chamber 5. Said channels 7 will be preferably identical, and their section increases (or decreases) from one end of the piston to the other.

When the lining 4 is fitted, a certain quantity of cooling fluid (oil, sodium, etc.) is confined inside chamber 5.

Whilst the engine is running, the heat to be evacuated comes from the combustion chamber and is transmitted to piston 1 on its bottom **1*a* side. After the explosion, the piston 1 moves in the direction of arrow F and the cooling fluid which had gathered in chamber 5*a* on the bottom 1*a* side is first of all carried by the movement of the piston. When said piston slows down and, in the end, stops, the cooling fluid continues moving by inertia in the direction of arrow F using those of channels 7 whose section is largest close to the bottom 1*a* of the piston. The fluid speed increases rapidly in the channels 7 of decreasing section, and becomes very high when the fluid reaches shoulder 4*b*. The heat transfer is then adequate between the cooling fluid and the annular portion 2 cooled by the scavenging air, due in particular to blades 3**.

Similar phenomena occur during the return stroke of the piston, the cooling fluid arriving at high speed into volume **5*a* as soon as the piston stops, after compressing the fuel mixture. Heat transfer between the bottom 1*a*** of the piston and the cooling fluid then takes place in favorable conditions.

The invention may be carried out on most pistons of internal combustion engines, and especially on those which are difficult to cool by the currently known means. Although in the example of embodiment illustrated hereinabove, the ribs 6 are produced with the lining 4, it is obvious that these ribs could just as well be produced with the piston 1. As we indeed know, the piston and the lining 4 are generally constituted of parts which are first molded and then machined, this permitting to readily produce the said ribs.

What I claim is:

1. A piston for an internal combustion engine, such as a free piston engine; said piston comprising:

an assembly of a pair of respectively inner and outer coaxial cylinders secured one to the other, at least the outer cylinder being hollow, the inner cylinder having an external diameter which is substantially less than the inner diameter of the outer cylinder, thus defining a closed and sealed annular chamber between said cylinders for receiving a volume of a cooling fluid less than the total volume of said chamber; and longitudinal ribs in the closed and sealed annular chamber which ribs extend over most of the height of said chamber and are inclined in alternate directions with respect to the piston axis, thus defining in said chamber a first plurality of longitudinal channels whose section increases from one end of the piston to the other end and a second plurality of longitudinal channels whose section decreases from said one end to said other end.

2. A piston as claimed in claim 1 having a combustion chamber side; wherein:

on said side the inner and outer cylinders are respectively formed with flat bottom walls which are in spaced-apart relation to each other and define therebetween a flat volume communicating with said closed and sealed annular chamber, said longitudinal channels issuing into said flat volume.

3. A piston as claimed in claim 1; wherein the channels of said first plurality alternate with the channels of said second plurality in the circumferential direction of said annular chamber.

* * * * *